US006074598A

United States Patent [19]

Koffron et al.

[11] Patent Number: 6,074,598

[45] Date of Patent: Jun. 13, 2000

[54] METHOD AND APPARATUS FOR SLAG SEPARATION SENSING

[75] Inventors: Robert J. Koffron; Jeffrey Jacobs, both of Farmington Hills, Mich.

[73] Assignee: Tetron, Inc., Farmington Hills, Mich.

[21] Appl. No.: 09/094,748

[22] Filed: Jun. 15, 1998

[51] Int. Cl.[7] ..... C21B 7/12; C21B 7/24

[52] U.S. Cl. ..... 266/45; 266/90; 266/99; 266/230

[58] Field of Search ..... 266/90, 94, 99, 266/227, 230, 236, 45

[56] References Cited

U.S. PATENT DOCUMENTS

| | | | |
|---|---|---|---|
| 2,718,389 | 9/1955 | Perrin . | |
| 2,810,169 | 10/1957 | Meyers . | |
| 3,934,755 | 1/1976 | Rheinlander et al. . | |
| 4,248,409 | 2/1981 | Langlitz et al. . | |
| 4,307,269 | 12/1981 | Rotthaus . | |
| 4,310,278 | 1/1982 | Wenzel et al. . | |
| 4,350,241 | 9/1982 | Wenzel . | |
| 4,360,305 | 11/1982 | Dorsch . | |
| 4,390,170 | 6/1983 | Schaefer, IV et al. . | |
| 4,401,296 | 8/1983 | Ploetz et al. . | |
| 4,413,810 | 11/1983 | Tenberg et al. . | |
| 4,431,169 | 2/1984 | Fuzii et al. | 266/236 |
| 4,462,574 | 7/1984 | Keenan et al. . | |
| 4,468,013 | 8/1984 | LaBate . | |
| 4,478,392 | 10/1984 | Fuzii . | |
| 4,494,734 | 1/1985 | LaBate et al. . | |
| 4,526,349 | 7/1985 | Schwer . | |
| 4,544,140 | 10/1985 | Tenberg et al. . | |
| 4,553,743 | 11/1985 | LaBate, II et al. . | |
| 4,556,097 | 12/1985 | Burmeister . | |
| 4,601,415 | 7/1986 | Koffron | 266/227 |
| 4,634,106 | 1/1987 | LaBate, II . | |
| 4,706,944 | 11/1987 | Lee . | |
| 4,709,903 | 12/1987 | LaBate . | |
| 4,718,644 | 1/1988 | Hoffman et al. | 266/99 |
| 4,725,045 | 2/1988 | Cutre et al. . | |
| 4,799,650 | 1/1989 | LaBate . | |
| 4,871,148 | 10/1989 | Koffron | 266/230 |
| 4,880,212 | 11/1989 | Hagglund et al. . | |
| 4,887,798 | 12/1989 | Julius | 266/99 |
| 4,986,517 | 1/1991 | Ford et al. . | |
| 5,044,610 | 9/1991 | Koffron . | |
| 5,190,717 | 3/1993 | Bayliss . | |
| 5,203,909 | 4/1993 | Petrushka et al. . | |

FOREIGN PATENT DOCUMENTS

| | | |
|---|---|---|
| 1063860 | 5/1952 | France . |
| 286132 | 6/1922 | Germany . |
| 52-22602 | 6/1977 | Japan . |
| 59-47314 | 3/1984 | Japan . |

*Primary Examiner*—Scott Kastler
*Attorney, Agent, or Firm*—Brooks & Kushman P.C.

[57] ABSTRACT

A method and apparatus for improving the yield of molten metal discharged from a metal production vessel limits the slag carryover by reducing turbulence of metal pouring through a discharge opening by inhibiting a vortex over the discharge opening, automatically sensing the presence of slag in the discharge opening, and terminating discharge through the opening in response to the detection of changing content through the discharged opening passage. Preferably, the inhibiting function includes inserting a slag reduction device, preferably a refractory body and maintaining the position of the device over the discharge nozzle. Preferably, the sensor is an electromagnetic coil that determines the change in content of the flow through the opening passage without direct contact with the contents of the opening. The combination of the slag vortex inhibitor and the flow content sensor is substantially improved metal pouring yield as demonstrated by actual slag reduction results.

12 Claims, 3 Drawing Sheets

METHOD AND APPARATUS FOR SLAG SEPARATION SENSING

FIELD OF THE INVENTION

The present invention relates generally to maintaining separation between a slag layer and the molten metal as metal is discharged from metal production vessels, and improving the sensing of the slag content in the flow discharging through the discharge opening.

BACKGROUND ART

In metal making processes, such as steel making, a layer of slag comprising metal impurities lies atop the surface of the molten metal held within a receptacle. When the molten metal is drained from the receptacle, separation of the slag and molten metal improves the quality of steel being discharged, as the flow is not contaminated by the slag. One example for maintaining the separation includes providing a receptacle with discharge opening located in the bottom wall of the vessel so that the opening is in fluid contact only with the layer of molten metal in the production vessel and is separated from the slag at the top surface of the molten metal. However, in previously known vessels, the flow of molten metal through the discharge opening, such as a tap hole or a pouring bore which may in turn, be provided with a sleeve or a nozzle with an opening, causes a vortex which introduces a swirl to the molten metal within the vessel above the discharge opening which can mix the slag with the metal.

As the level of the contents of the vessel decreases, a minor swirl is imparted to the fluid, but may not affect the separation between the slag layer and the steel layer. However, when the fluid level reaches a certain depth which is dependent upon the size of the discharge opening, the vortex forms a funnel which sucks the slag layer down through the center of the vortex and into the discharge opening along with the high quality molten metal. At this point, the quality of the strand being formed is affected by contamination of the pour with the slag. As a result, flow may be halted before substantial contamination reduces quality of the product. However, the remaining metal is removed from the vessel as scrap or hardens in the vessel for subsequent remelting. Unfortunately, the level of fluid at which the vortex suction effect occurs is relatively high, whereby a substantial amount of high quality molten metal remains trapped within the vessel and must be abandoned from the process.

One previously known improvement provides a refractory body adapted to inhibit the vortex effect and permit a greater quantity of high quality molten metal to be poured from the vessel without the intermixture of slag. The body generally comprises a tapered, polygonal body having means for supporting the body at the interface of the layer of slag and molten metal to inhibit the suction effect which occurs when the vortex is formed at the critical level. Preferably, the body is made with a refractory material with a specific gravity that makes it buoyant but provides a submerged portion as it is self-supported at the slag layer/metal interface. Such a body extracts sufficient energy from the vortex to avoid the formation of a suction-effect funnel and prevents intermixture of the slag and the molten metal. In addition, when the apex of a buoyant tapered body is oriented directly downward toward the discharge opening so that as the apex approaches and begins to enter the nozzle opening, a throttling effect is initiated. The change in flow volume by throttling to provides a means for detecting that the level of slag is approaching the opening. However, the throttling effect of reduced flow may not occur as desired where the shape of the body has been changed substantially due to the harsh temperature, chemical and kinetic conditions occurring in the vessel. Moreover, the throttling effect is often detected by observation, and may be difficult to discern under the harsh environmental conditions of the processing equipment.

As a result, substantially less high quality metal may be poured than is available to assure that the quality of the discharged metal remains high. Substantial energy input is required to reheat metal which has hardened within a vessel or dumped out with slag removal process. In addition, it has heretofore been difficult to detect or sense when the level of molten metal is at the critical level in the vessel. Since the suction action of the vortex draws the slag into the center of the vortex, a person observing the flow discharging through the opening cannot see that slag is flowing through the opening since molten metal surrounds the slag as it passes through the opening. Rather, in operation of pouring from a ladle to a tundish, for example, the surfacing of slag in the tundish was relied upon to provide an indication that the molten metal had reached the critical level in the ladle, but such an indication occurs only after contamination of the high quality steel in the tundish.

Although sensors have been made to detect the presence of slag in the flow of metal, the continuously changing conditions including turbulence and heat, have affected the ability of previously known sensors to provide highly accurate or reliable responses to the presence of slag in the flow. The sensor signals must also be amplified, filtered and digitally processed by a measuring and control unit. Unavoidable drifts in sensor response are caused by temperature changes and must be compensated. As a result, merely improving the sensitivity of the previously known sensors does not provide an improved result of reducing contamination while limiting the amount of quality metal that must be retained in the vessel.

SUMMARY OF THE INVENTION

The present invention overcomes the above-mentioned disadvantages by a method and apparatus for improving the accuracy of detecting the initiation of slag contamination in the metal flowing through a discharge opening. In general, inhibiting the formation of a vortex over the discharge opening substantially reduces the turbulence of flow at the entry of the opening to limit premature entry of slag into the discharge opening, and enhances the operation of the slag content sensor to distinctly detect the transition point when slag enters the flow passing through the discharge opening. The transition from steel to slag is more easily identifiable and the sensor response more distinctly representative of a changing content condition in the flow, than with previously known slag sensing apparatus and with the previously known flow throttling detection sensors.

In the preferred embodiment, the slag content is sensed by detecting the metal content of flow through the opening. Preferably, changes in the permeability of the flow through the opening is sensed. One particularly preferred form of sensor includes an electromagnetic coil wrapped around the opening passage, preferably carried by a nozzle body where attachment about the opening is difficult, so that the electromagnetic changes that correspond with changes of permeability occurring when slag enters the opening can be readily detected. Nevertheless, alternative sensors can be employed such as vibration sensors, accelerometers, electrochemical, resistivity, optical or conductivity sensors that detect changes in characteristics related to flow content in through the opening.

In a preferred process, a buoyant refractory body is inserted into a vessel containing the molten metal, preferably at a time just prior to formation of the vortex above the discharge opening. Although the body can be maintained in a position above the opening by external means such as a movable guide arm, or a fixed position frame, preferably, the specific gravity of the refractory body is selected to buoyantly support the body at the slag interface with the metal and the body is placed into proper position. Preferably, the specific gravity is selected to maximize the volume of the submerged portion and thus improve the upright stability of the body and maximize resistance to vortex formation. Preferably, the body is shaped to generally conform with the shape of the vortex to improve the turbulence inhibiting affect of the refractory body. Moreover, the shape may be otherwise adjusted, for example, the proportions of the refractory body may be adjusted to position the center of gravity below the center of buoyant support, i.e., metacenter, of the body.

As a result, the quantity and quality of yield from a metal pouring process is improved by reducing the changing conditions, reducing their effects upon flow content at the discharge opening, and improving detection as well as the response to detection of slag intermixture. The combination of force controls, sensor types and sensor positions permit reliable and distinctive indications of slag entry to the opening, even though less expensive or less precise sensors, or less sophisticated sensors, monitors or controls may be employed. Moreover, unlike the reduced flow (throttling) detection previously employed in previously known systems, and the previously known use of vortex inhibitors, the combination and the system of the present invention are not susceptible to differences in results, even where substantial changes occur in the shape and size of the inhibiting body due to the harsh environmental conditions.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which.

DETAILED DESCRIPTION OF THE PREFERRED EMBODIMENT

Figure 1:
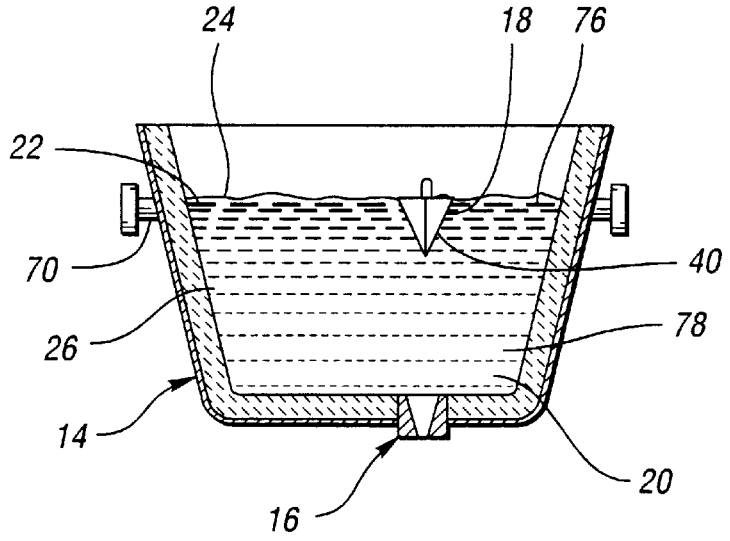
FIG. 1 discloses two related vessels in a metal pouring process adapted to use the method and apparatus of the present invention.

Referring first to FIG. 1, a plurality of vessels 10 are thereshown comprising a furnace 12, which may be a basic oxygen furnace (BOF), or an eccentric bottom tapping (EBT) furnace as shown, or other known type, and a ladle 14. Each vessel 10 is provided with a discharge opening 16 positioned below the surface 18 of the load 20. Typically, the load 20 includes a layer of slag 22, on a top surface 24, of a molten metal layer 26. Nevertheless, it is to be understood that the vessel 10 may be a furnace 12, which may be operated in the position shown in phantom line to heat the raw materials for processing metal, and then tilted to another position as shown in solid line in FIG. 1 for discharging the load 20 through an opening 16 in the form of a tap hole. Moreover, as the load 20 is discharged from the furnace 12, it is often poured into a ladle, as shown in 14, for transport to another pouring process. Likewise, the ladle 14 may discharge its load 20 through an opening 16 in the form of a pouring bore, into another vessel such as the tundish 30 shown in FIG. 2. The tundish 30 in turn, may discharge its load through an opening 16, preferably in the form of an attached, replaceable nozzle 17, into a continuous strand caster receptacle. Any of the discharging receptacles are vessels 10 that may benefit from practicing the present invention.

The tundish 30 includes a discharge opening 16 that enables the load 20 to be delivered to a storage receptacle or a strand mold. Although the operation of a discharge opening 16 for the ladle 14 will be described in further detail, it is to be understood that the benefits of practicing the discharge teachings of the present invention are equally applicable to other metal processing vessels 10 such as the furnace 12, tundish 30 or other molten metal receptacles, without departing from the scope of the present invention.

Figure 2:
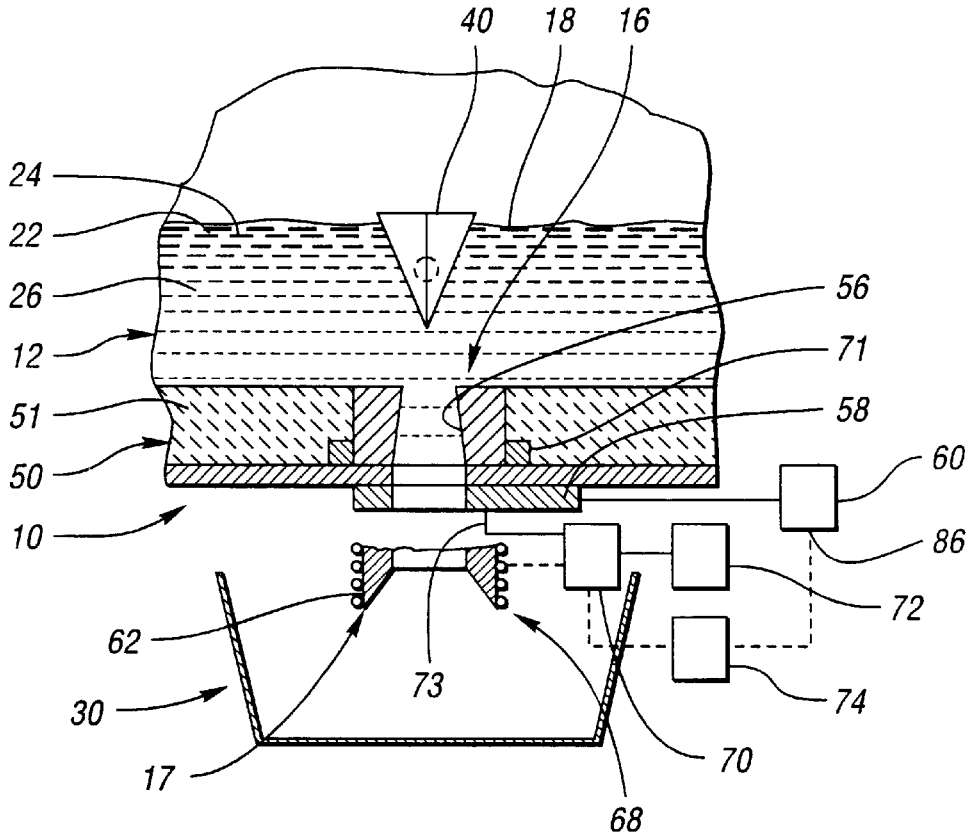
FIG. 2 is an enlarged sectional view taken of a portion of the apparatus shown in FIG. 1.

As best shown in FIG. 2, the interface or metal layer surfaces 24 between the layer of slag 22 and the molten metal layer 26 is maintained due to the difference in the specific gravity between the slag layer and the molten metal. Similarly, when a refractory body 40 is used as the vortex inhibiting device, preferably a tapered body and preferably made of a castable refractory material, the specific gravity of the substantially uniform refractory body is adjusted to a specific gravity less than the specific gravity of the molten metal. The adjustment is incorporated by using metal sharps, threads, balls, or the like mixed with the refractory material 30 that the body remains buoyant in the molten metal layer 26 but submerges a large portion of the body below the surface 24 of the metal layer. Such adjustment improves the volume of inertial mass that resists the vortex formed in the molten metal layer. Nevertheless, supported non-buoyant bodies, rigid structures and other slag dam devices may have some effect as vortex inhibitors.

In addition to the buoyancy adjustment, the body is shaped so that the body remains stabily supported with the center of gravity below the center of buoyant support. As a result, the floating body maintains a stabilizing moment that tends to uniformly position of the body in a predictable alignment with respect to the layer of molten metal. Nevertheless, it may be understood that the position of the body may be maintained in its position, regardless of its shape by external means. In particular, moveable guide arms may displace and position the refractory body with respect to the housing 50, so that the body may be positioned within chamber 19 carrying the load 20. Alternatively, the body position may be maintained by a rigid frame to the housing 50. In any event, some means is provided for maintaining the refractory body in a position over the discharge opening 16.

In addition, in accordance with the previous teachings of U.S. Pat. No. 4,601,415, the refractory body may be tapered toward an apex so that it generally conforms with the shape of the vortex being formed above the discharge opening. In addition, the base of the body can be a simple or a complex polygon, circular, or other shapes depending on the shapes of the protrusions, walls, or grooves formed in the body. However, the body may also be shaped as desired, and may include enlarged body structures or protrusions that prevent entry of the body into the passageway 54 of the opening 16.

Still referring to FIG. 2, the opening 16 may be structured as desired. In a preferred embodiment, the opening comprises a nozzle sleeve 56 installed in and formed as part of the vessel housing 50 to provide a passage 56 therethrough. The passage 56 communicates with the chamber 19 and with the exterior of the vessel 10. In addition, the passage 56 may be selectively closed by a gate 58 which is selectably operable by an operator 60 to close and open the passage 56. The operator 60 may be manually controlled or automatically controlled by a controller 74 including computer processor hardware and software for machine operation as described in greater detail below. The sensor ring 63 is positioned adjacent the refractory lining 51 about the sleeve 56 when the sleeve is installed or replaced for maintenance.

Alternatively, an elongated depending portion of the sleeve 54 carries a coil 66 that forms a part of the sensor 68. The coil 66 is connected within the sensor circuit 70, preferably an electromagnetic signal sensor circuit, which provides an output signal that varies in proportion to the changes in permeability of the material flowing through the opening. In a preferred embodiment for a ladle, a rigid steel ring 71 forms a cassette enclosing a plurality of coils, the ends of the coils being coupled to protruding conductor leads. Nevertheless, it may be understood that the sensor 68 may be formed in a substantially different manner, for example, electrodes extending into the flow to determine conductivity between the electrodes, or other content sensing sensors that may react to changes in the contents flowing through the opening. In addition, slag detection cameras, acoustic, vibration, thermal and optical systems may be used.

In any event, the circuit 70 is coupled to a reactor for example, a physical signal indicator 72 that can be perceived or heard by a worker who may then be able to close the gate 58 by actuating the operator 60. Alternatively, the reactor may be a control circuit 74 that responds to the change in sensor signal output from the circuit 70, as shown at 74. The controller 74 provides an output in response to the sensor signal to automatically actuate the operator 60 and provide an automated response to the sensing of a change in contents flowing through the opening passage 56. The controller 74 may also be responsive to hand terminals, control panels or the like for controlling electrical power to the actuator 60 and the sensor circuit 70; and the computer processor controller for machine operations.

As a result, a change of contents in the flow of molten metal from the layer 26 to a combination of slag 22 and molten metal 26 can be sensed by the change of permeability of the inductor core formed by the flow through the opening passage 56 within the coil 66. As a result, a sensor 68 is quite sensitive to the change of content, and does not depend upon entry of worn surfaces of the refractory body to throttle the flow through the discharge opening. Accordingly, the body 40 can be shaped to avoid entry within the opening passage 56.

Nevertheless, vortex inhibiting bodies having a part that can enter the opening may also be used in order to provide a preliminary indication of slag positioning that precedes the entry of slag into the opening content. Preferably, the opening in such a case would be elongated so that the sensor 68 may be spaced from the penetrated portion of the opening so that entry of a portion of the inhibitor body into the opening would not effect the reading provided by the circuit 70.

Alternatively, the protruding body portion may be long enough to affect the sensor and thereby provide a preliminary indication to the sensor circuit that the height of the slag over the load 20 is at a point whereby subsequent changes in content will be understood to be due to the entry of slag with metal content in the opening passage 56. In particular, the refractory bodies having shapes that do not readily enter the opening may provide a more stable condition for inhibiting vortex swirl above the discharge opening as they provide higher inertia to resist the swirl. Moreover, the elimination of a suction vortex reduces turbulence and chaotic mixture of the slag layer with the molten metal for a substantial portion of the pour. As a result, the combination of the vortex inhibitor and the flow content sensor provides a synergistic effect upon the amount of slag transferred from the vessel.

Figure 3:
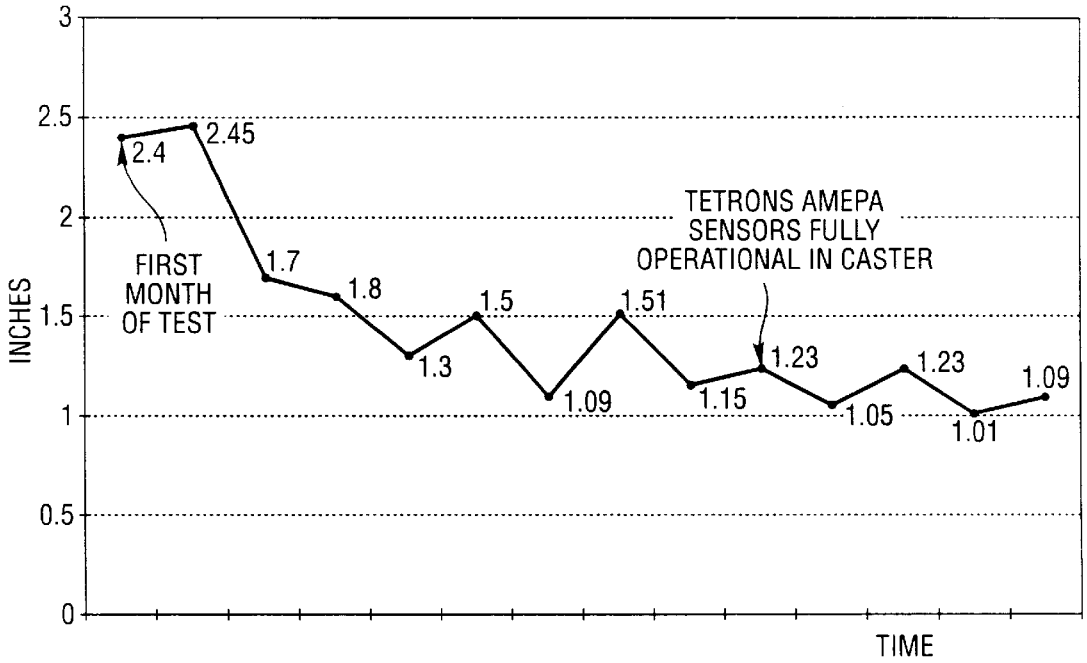
FIG. 3 is a graphical representation of improved control of slag carryover that relates to improved yield from metal pouring operations incorporating the method and apparatus of the present invention.

Referring now to FIG. 3, preliminary data was compiled for comparing average tundish slag depth as the combination of slag reduction devices, such as vortex inhibitors, and the sensors was applied to the ladles (vessels) as ladles were cycled into and out of service. The slag measurements refer to the inches of slag that are in the tundish after molten metal is discharged from each ladle and synthetic flux is added to the tundish.

Figure 4:
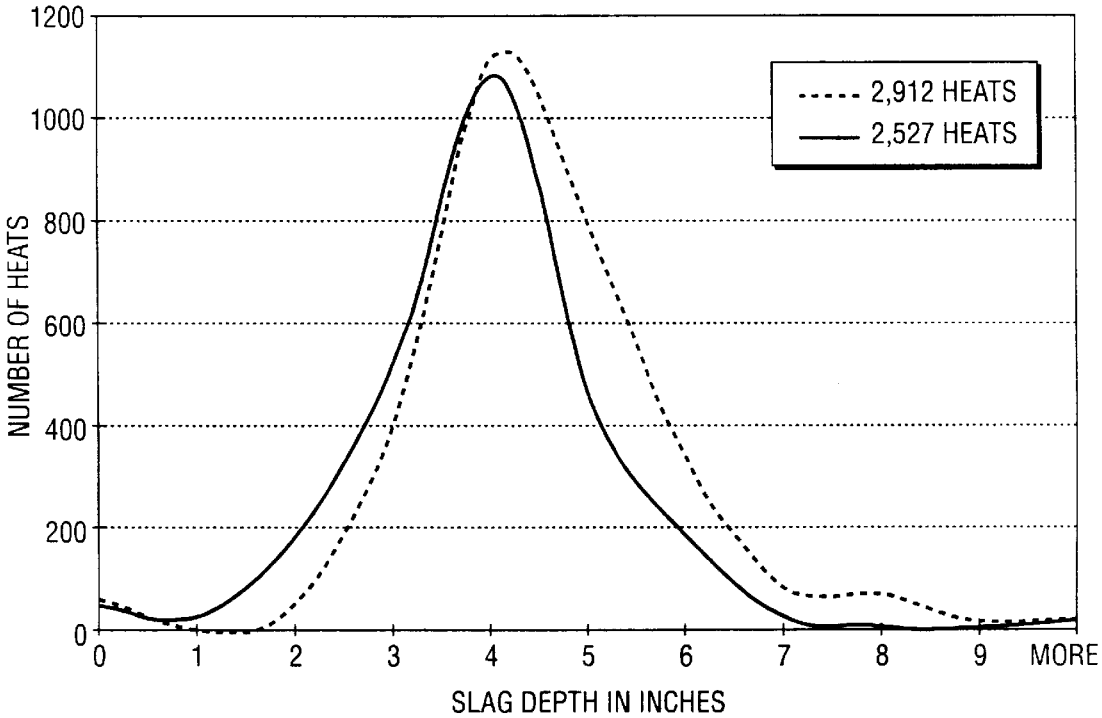
FIG. 4 is a graphical representation of slag carryover control that relates to improved yield in another metal pouring process incorporating the method and apparatus of the present invention.
Figure 5:
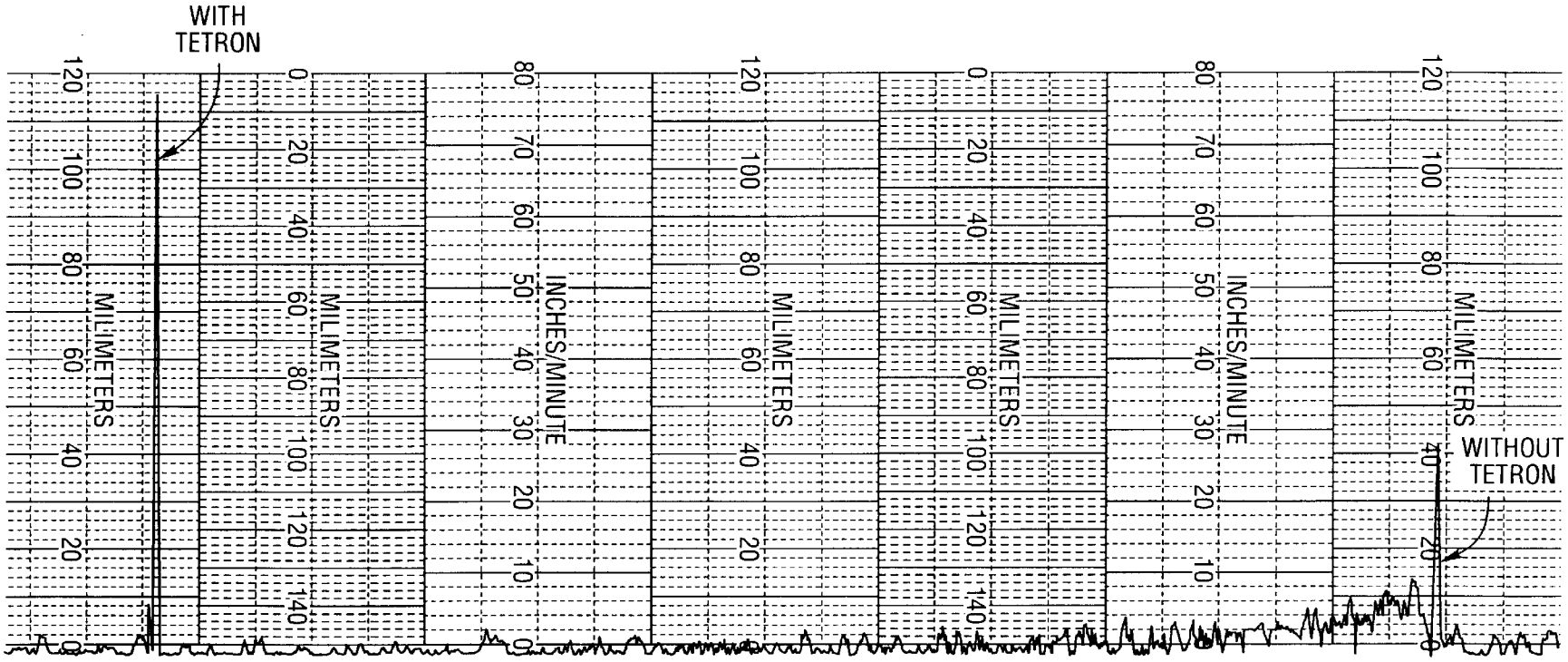
FIG. 5 is a graphic representation of the differential of flow content changes over time and comparing a pour from a first ladle with a sensor plugged into a monitor and using no vortex inhibiting device with a pour from a second ladle with a sensor plugged into the monitor and using a vortex inhibitor according to the present invention.

As shown in FIG. 4, improvement provided by the combination of slag reduction devices and sensors in the quality of the yield from the BOF vessel is graphically demonstrated. Although the differences of about one inch in the mean depth comparison of slag layers in the ladle to which the furnace discharges molten metal may initially appear relatively small when viewed in light of the total slag depth of about four inches, about 70% of the slag layer depth in the ladle is added synthetic flux to change the metallurgy to reduce interaction of the metal layer with the slag layer. The total slag depth is due almost entirely to the amount of slag fluxes added to the receiving vessel. As a result, each inch of slag which has not been removed from an initiating vessel represents a substantially greater yield of metal from the initiating vessel as well as a higher quality of metal into the receiving vessel.

Having thus described the present invention, many modifications thereto will become apparent to those skilled in the art to which it pertains without the departing from the scope and spirit of the present invention as defined in the appended claims.

What is claimed is:

1. A method for improving the yield of molten metal discharged from a metal production vessel, the vessel having a discharge opening, the method comprising:

limiting the turbulence of metal pouring through the opening by inserting a slag reduction body above the nozzle at a position not restricting the opening, and maintaining the position of said body over said discharge opening independently of the discharge opening;

automatically sensing the presence of slag in said discharge opening at a position below said slag reduction body where said turbulence has been limited; and terminating discharge through said opening in response to detection of the presence of slag in said area of limited turbulence in said discharge opening.

2. The invention as defined in claim 1, wherein said limiting function comprises inserting a refractory body tapered to generally conform with the shape of the vortex.

3. The invention as defined in claim 1 wherein said limiting function comprises inserting a refractory body geometrically proportioned with refractory material to maintain a stable upright orientation with a center of gravity below a center of buoyant support.

4. The invention as defined in claim 1 wherein said sensing function comprises sensing the permeability of the flow through the discharge opening.

5. The invention as defined in claim 1 wherein said sensing function comprises sensing the conductivity of the flow through the discharge opening.

6. The invention as defined in claim 1 wherein said body is a refractory body with a specific gravity less than the specific gravity of the molten metal so that said body is buoyantly supported above the discharge opening.

7. In combination with a metal pouring vessel containing a molten metal load, and including a discharge opening for discharging the metal load from the vessel, the improvement of a combination of structures controlling flow content through the opening by limiting turbulence in flow through the nozzle comprising:

a refractory body having a specific gravity less than the specific gravity of the molten metal to buoyantly support the body with a submerged portion;

means for positioning the buoyantly supported body and said submersed portion above the discharge opening; and a sensor detecting the presence of slag in the flow through said discharge opening at a position below said refractory body and within said discharge opening.

8. The invention as described in claim 7 wherein said sensor detects the permeability of the flow through the opening.

9. The invention as described in claim 8 wherein said sensor is a coil wrapped around said opening.

10. A method for improving the yield of molten metal discharged from a metal production vessel, the vessel having a discharge opening, the method comprising:

reducing turbulence in flow through the opening by inhibiting a vortex with a body at a position above the discharge opening to provide a more distinct transition between flow content changes within the opening;

automatically sensing the presence of slag at a position within said discharge opening; and terminating discharge through said opening in response to detection of slag at a position within said opening.

11. The invention as defined in claim 10 wherein said sensing function comprises sensing the permeability of the flow through the discharge opening.

12. The invention as defined in claim 10 wherein said sensing function comprises sensing the conductivity of the flow through the discharge opening.

* * * * *

UNITED STATES PATENT AND TRADEMARK OFFICE

CERTIFICATE OF CORRECTION

PATENT NO : 6,074,598

DATED : June 13, 2000

INVENTOR(S) : Robert J. Koffron et al

It is certified that error appears in the above-identified patent and that said Letters Patent are hereby corrected as shown below:

Column 7, Line 29, Claim 7: delete "submersed" and insert --submerged--.

Signed and Sealed this

Third Day of April, 2001

*Attest:*

Nicholas P. Godici

NICHOLAS P. GODICI

*Attesting Officer*

*Acting Director of the United States Patent and Trademark Office*